US007793477B1

(12) United States Patent
Potts

(10) Patent No.: US 7,793,477 B1
(45) Date of Patent: Sep. 14, 2010

(54) ROOF DECK AND METHOD OF MANUFACTURING A CLIP

(75) Inventor: Stephen Potts, Cranberry Township, PA (US)

(73) Assignee: Epic Metals Corporation, Rankin, PA (US)

( * ) Notice: Subject to any disclaimer, the term of this patent is extended or adjusted under 35 U.S.C. 154(b) by 0 days.

(21) Appl. No.: 11/969,372

(22) Filed: Jan. 4, 2008

Related U.S. Application Data

(62) Division of application No. 10/656,936, filed on Sep. 5, 2003, now abandoned.

(60) Provisional application No. 60/408,632, filed on Sep. 6, 2002.

(51) Int. Cl.
*E04B 2/14* (2006.01)
*E04B 2/42* (2006.01)

(52) U.S. Cl. ..... 52/404.2; 52/407.4; 52/407.1; 52/506.08; 52/144

(58) Field of Classification Search ..... 52/404.2, 52/407.4, 407.1, 715, 714, 712, 703, 699, 52/698, 144, 506.08, 506.06, 6; 24/350; 248/74.2
See application file for complete search history.

(56) References Cited

U.S. PATENT DOCUMENTS 1,146,251 A 7/1915 Harp
1,218,211 A 3/1917 Rowe
1,407,709 A 2/1922 Tibbals
1,562,784 A 11/1925 Olsen
1,610,578 A * 12/1926 Murphy ..... 52/402
1,937,843 A * 12/1933 Randall ..... 52/407.4
2,001,733 A * 5/1935 Kellogg ..... 52/144
2,007,374 A * 7/1935 Kuehne ..... 52/145
2,164,138 A * 6/1939 London ..... 52/407.4
2,227,570 A 1/1941 Burson
2,228,650 A * 1/1941 Young et al. ..... 52/407.1
2,256,961 A * 9/1941 Pearson et al. ..... 52/407.4
2,284,229 A * 5/1942 Palmer ..... 52/578
2,326,717 A * 8/1943 Zeidler ..... 52/407.1
2,330,941 A * 10/1943 Acuff, Jr. ..... 52/407.1
2,418,539 A 4/1947 Anderson
2,476,499 A * 7/1949 Lowell ..... 52/630
2,799,232 A * 7/1957 Jaeger ..... 52/409
2,981,513 A 4/1961 Brown
3,020,602 A 2/1962 Siering
3,082,487 A * 3/1963 Fowler et al. ..... 52/145
3,266,761 A 8/1966 Walton et al.
3,296,761 A * 1/1967 Varlonga ..... 52/278
3,363,373 A 1/1968 Huss, Jr.
3,465,486 A * 9/1969 Rolin ..... 52/222
3,537,222 A 11/1970 Lickliter et al.
3,583,663 A 6/1971 Snow, Jr.
3,589,660 A 6/1971 Dunckel
3,676,967 A 7/1972 Frati
3,684,223 A 8/1972 Logsdon (Continued)

*Primary Examiner*—Phi Dieu Tran A
(74) *Attorney, Agent, or Firm*—The Webb Law Firm

(57) ABSTRACT

A roof deck including a structural panel, a sound-absorbing media and a plurality of clips. The structural panel includes a bottom member, an upper member and a receiving cavity therebetween. The clip includes a body having a first side and a second side, a step portion, and a first prong member projecting outward from the first side of the body. At least one clip is inserted into the sound-absorbing media which is placed into the receiving cavity of the structural panel.

8 Claims, 2 Drawing Sheets

U.S. PATENT DOCUMENTS 3,694,981 A * 10/1972 Cremer et al. ..... 52/235
3,757,629 A 9/1973 Schneider
3,789,800 A 2/1974 Steudler, Jr.
3,802,655 A 4/1974 Schuplin
3,805,471 A 4/1974 DeSchutter
3,848,839 A 11/1974 Tillman
4,130,175 A * 12/1978 Hehmann ..... 181/290
4,220,070 A 9/1980 Anstett
4,266,384 A * 5/1981 Orals et al. ..... 52/410
4,333,290 A * 6/1982 Koberstein ..... 52/376
4,346,544 A * 8/1982 Larssen ..... 52/407.4
4,356,987 A 11/1982 Schmid
4,367,616 A * 1/1983 Pearson ..... 52/664
4,395,858 A 8/1983 Gwyther
4,428,376 A 1/1984 Mericle
4,439,899 A 4/1984 ReuBoiu et al.
4,440,099 A 4/1984 Brachet et al.
4,441,680 A 4/1984 Rivkin et al.
4,464,876 A * 8/1984 Kern ..... 52/506.06
4,526,756 A 7/1985 Wong
4,570,623 A 2/1986 Ellison et al.
4,598,518 A * 7/1986 Hohmann ..... 52/410
4,793,335 A 12/1988 Frey et al.
4,941,630 A 7/1990 Albano
5,005,789 A 4/1991 Jones
5,149,026 A 9/1992 Allen
5,149,027 A 9/1992 Weber
5,423,156 A 6/1995 Nellessen, Jr.
5,588,541 A 12/1996 Goetz
5,759,004 A 6/1998 Kuffel
5,782,551 A * 7/1998 Capaul ..... 362/148
5,809,723 A 9/1998 Keith et al.
6,216,320 B1 4/2001 Schauermann
6,237,300 B1 5/2001 Carne et al.
6,390,420 B1 5/2002 Rooney
6,464,180 B2 10/2002 Workman
6,941,717 B2 9/2005 Hohmann et al.
2003/0079433 A1 5/2003 Leek et al.

* cited by examiner

ROOF DECK AND METHOD OF MANUFACTURING A CLIP

CROSS-REFERENCE TO RELATED APPLICATIONS

This application is a divisional of U.S. application Ser. No. 10/656,936, filed Sep. 5, 2003, which claims the benefit of U.S. Provisional Patent Application No. 60/408,632, filed Sep. 6, 2002, which is hereby incorporated by reference in its entirety.

BACKGROUND OF THE INVENTION

1. Field of the Invention

The present invention relates to a roof deck and a method for making a clip and, more particularly to a roof deck with clips for use with sound-absorbing media.

2. Description of Related Art

Typically acoustical roof decks include a profiled member having a perforated flat portion with sound-absorbing media received within a cavity. The sound-absorbing media is spaced a distance from the perforated members. Various types of spacers have been used in the sound-absorbing media to provide such a function. One such example is the use of clips that slide onto the ends of the sound-absorbing media, as seen in FIGS. 1A and 1B. However, problems exist with these prior art clips, as they must be sized based upon the thickness of the sound-absorbing media for individual applications. These clips prove to be inefficient as well as costly. Further, during installation, these clips have a tendency to fall off the sound-absorbing media.

Therefore, it is an object of the present invention to provide an apparatus and method for efficiently making a sized clip for universal uses and having improvements to overcome the deficiencies of the prior art.

SUMMARY OF THE INVENTION

The present invention is directed to a roof deck. The roof deck includes a structural panel, a sound-absorbing media, and a plurality of clips. The structural panel includes a bottom member, an upper member and a receiving cavity therebetween. The bottom member of the structural panel may be perforated. The sound-absorbing media may be fiberglass or the like. The clip includes a body having a first side, a second side, a step portion, and a first prong member projecting outward from the first side of the body. At least one clip is inserted into the sound-absorbing media which is placed into the receiving cavity of the structural panel. The clip further includes a second prong member projecting outward from the second side of the body. The first prong member extends in a first direction and the step portion extends in a second direction. The first prong member has a pointed end and at least one barb along a length of the first prong member. The shelf portion has about a 0.25 inch-0.50 inch step radius.

The present invention is also directed to a method of making a clip for use with sound-absorbing media. The steps include providing a flat blank having a first side and a second side. The blank is stamped to include a unitary body and at least one prong member, wherein at least one prong member is located at the first side of the blank. The blank is then formed to include a step portion and at least one prong member is bent.

A second prong member may be located at the second side of the blank. The first and second prong members may include a pointed end and at least one barb along a length of the prong member. The method may further include the step of bending the first and second prong member transverse to the body in a first direction with the step portion transverse to the body in a second direction. At least one prong member extends in a first direction and the step portion extends in a second direction.

DETAILED DESCRIPTION OF THE INVENTION

Figure 1A:
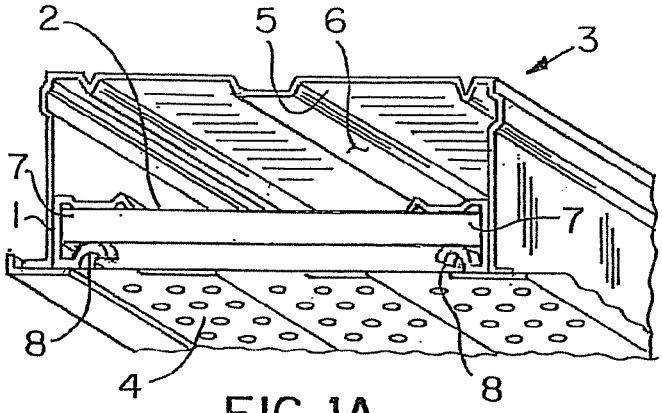
FIG. 1A PRIOR ART
FIG. 1A is a perspective view showing a prior art roof deck arrangement utilizing a prior art clip.
Figure 1B:
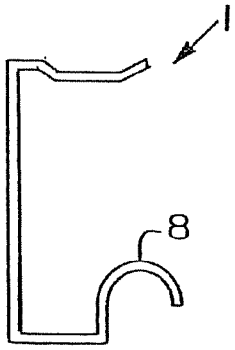
FIG. 1B PRIOR ART
FIG. 1B is a side elevational view showing the prior art clip shown in FIG. 1A.

FIGS. 1A and 1B illustrate a prior art clip 1 that fits on an end of sound-absorbing media 2 received within a structural panel 3. The panel 3 includes a bottom perforated member 4 and an upper profiled member 5 defining a sound-absorbing media receiving cavity 6. The clip 1 slides over an end 7 of the sound-absorbing media 2 and has a step 8 that raises the sound-absorbing media 2 off the perforated member 4.

Figure 2A:
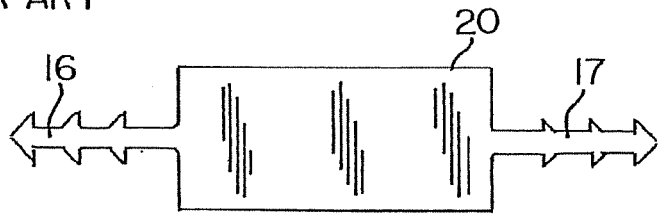
FIG. 2A is a top plan view of a blank used for making a clip in accordance with the present invention.
Figure 2B:
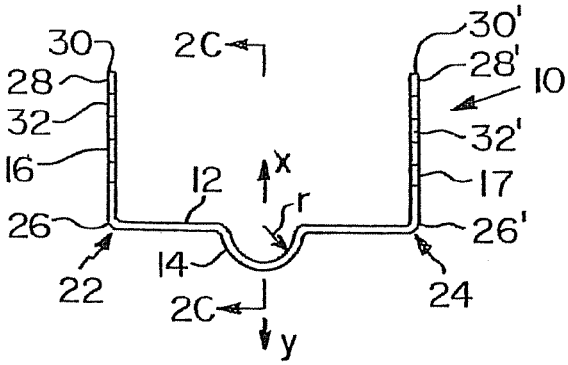
FIG. 2B is a side perspective view of a clip in accordance with the present invention.
Figure 2C:
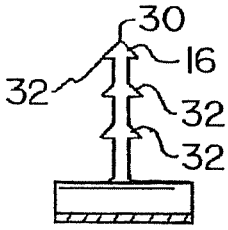
FIG. 2C is a side elevational view, partially in section, taken along lines 2C-2C in FIG. 2B.
Figure 2D:
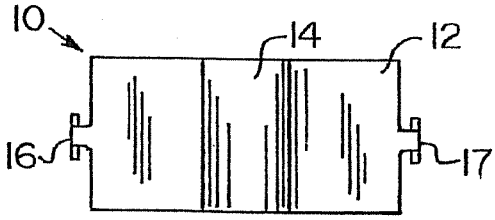
FIG. 2D is a bottom plan view of the clip shown in FIG. 2B.

FIGS. 2A-2D illustrate a clip 10 made in accordance with the present invention. Referring specifically to FIGS. 2B-2D, the clip 10 includes a body 12 having a step portion or bubble 14 depending therefrom and prong members 16 and 17. As can be seen, the clip 10 has at least one prong member, but preferably has two prong members.

The body 12 is preferably made from a flat blank 20, as illustrated in FIG. 2A and will be described in more detail hereinafter. The body 12 may be of any flexible rigid material. Preferably the body 12 is made of a metal such as steel, copper, aluminum or the like so that it can be formed, via a tool, to produce the clip 10. Additionally, the clip 10 may be of other material such as molded from plastic, or the like.

The body 12 has a first side 22 and a second side 24. The first side 22 and the second side 24 are on opposing ends or sides of the body 12. The first prong member 16 is located at the first side 22 of the body 12 and the second prong member 17 is located at the second side 24 of the body 12. The step portion 14 of the body 12 is located therebetween the first side 22 and the second side 24 of the body 12.

The prong members 16, 17 extend from the body 12 and each include a first end 26, 26' and an opposing end 28, 28'. The first ends 26, 26' of the prong members 16, 17 are located at the first side 22 of the body 12 and the second side 24 of the body 12, respectively. The opposing ends 28, 28' of the prong members 16, 17 are located opposite the first ends 26, 26' of the prong members 16, 17. The opposing ends 28, 28' of the prong members 16, 17 include pointed ends 30, 30'. The pointed ends 30, 30' allow for penetration of the prong members 16, 17 through the sound-absorbing media 2.

At least one barb 32, 32' is located along the length of the prong members 16, 17. Preferably, a plurality of barbs 32, 32', for example three barbs 32, 32' as illustrated in FIG. 2C, are located along the length of the prong members 16, 17. The barbs 32, 32' aid to maintain the clip 10 in the sound-absorbing media 2 as will be discussed in detail hereinafter. The prong members 16, 17 extend or project outward in a first direction x from the body 12. The step portion 14 of the body 12 extends in a second or opposing direction y from the prong members 16, 17.

The step portion 14 is adapted to rest on the bottom perforated member 4 of the panel 3 to raise the sound-absorbing media 2 from the panel 3. The prong members 16, 17 are adapted to engage with the sound-absorbing media 2. The depth of the step portion 14 may vary. For example, FIG. 2B illustrates a clip 10 having about a 0.25 inch step radius r. The radius r may vary in size and is preferably about 0.25 inch-0.50 inch. The step portion 14 may also take other shapes such as rectangular or triangular.

Figure 3:
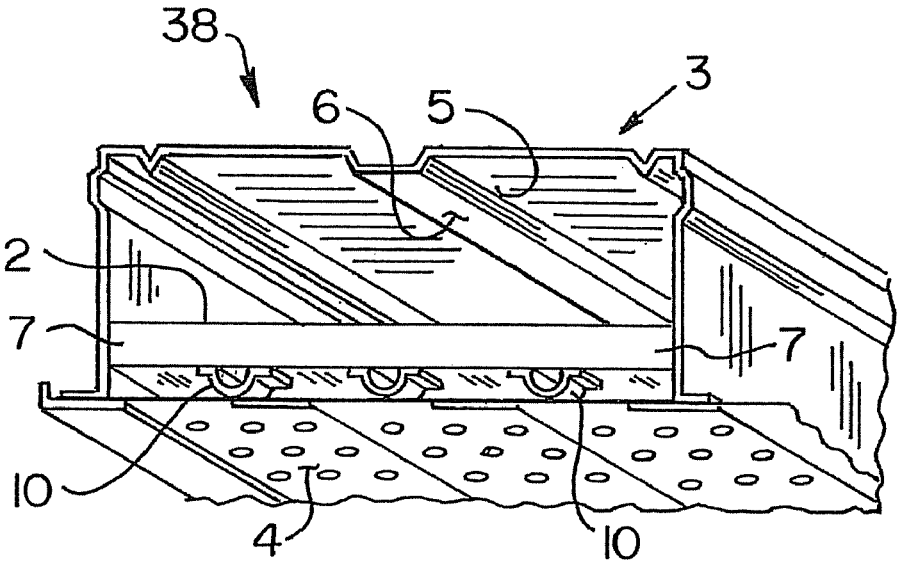
FIG. 3 is a perspective view of a roof deck in accordance with the present invention.

A roof deck 38, as illustrated in FIG. 3, includes a structural panel 3, a sound-absorbing media 2, and a plurality of clips 10. The structural panel 3 includes a bottom member 4, an upper member 5 and a receiving cavity 6 therebetween. The bottom member 4 of the structural panel 3 is perforated. The sound-absorbing media 2 is fiberglass or the like. A plurality of clips 10, as previously described are inserted into the sound-absorbing media 2 which is placed into the receiving cavity 6 of the structural panel 3.

Figure 4:
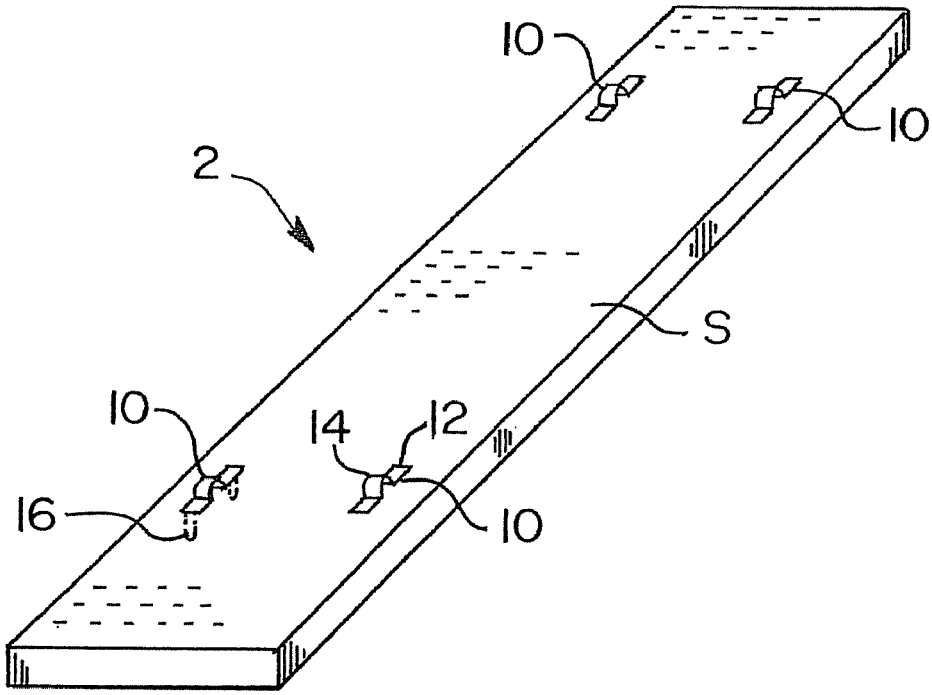
FIG. 4 shows a top perspective view of sound-absorbing media having a plurality of clips made in accordance with the present invention.

In further detail, FIG. 4 illustrates the sound-absorbing media 2 having four clips 10. As shown, the prong members 16, 17 of each of the clips 10 are inserted into the sound-absorbing media 2 until the body 12 rests against a surface S of the sound-absorbing media 2. The step portion 14 of the clips 10 extend from the surface S in an opposing direction from the prong members 16, 17 and when resting on a supporting member, such as the perforated member 4, support the sound-absorbing media therefrom.

The clips 10 may vary in orientation. For example, the clips 10 may be inserted into the sound-absorbing media 2 horizontally as shown in FIG. 3 or longitudinally as in FIG. 4. Also, the clips 10 may be placed in the sound-absorbing media 2 in any configuration effective to space or raise the sound-absorbing media 2 from the perforated member 4. For example, the clips 10 may be placed incrementally along the sound-absorbing media 2. The barbs 32, 32' along the prong members 16, 17 interact with the sound-absorbing media 2 preventing the clip 10 from being easily removed or pulling out therefrom, especially if the sound-absorbing media 2 is made of a fiberglass type of fibrous insulation or rock wool. The clipped sound-absorbing media 2 can then be inserted within the sound-absorbing media receiving cavity 6 so that the sound-absorbing media 2 is spaced from or raised from the perforated member 4. Therefore the clips 10 may be used universally in a variety of applications without the need for resizing.

The present invention is also directed to a method of making a clip for use with sound-absorbing media. The steps include providing a flat blank 20 having a first side 22 and a second side 24. The blank 20 is stamped to include a unitary body 12 and at least one prong member 16, wherein at least one prong member 16 is located at the first side 22 of the blank 20. The blank 20 is then formed to include a step portion 14 and then the at least one prong member 16 is bent.

A second prong member 17 may be located at the second side 24 of the blank 20. The method may further include the step of bending the first and second prong members 16, 17 transverse to the body 12 in a first direction x while the step portion 14 is transverse to the body 12 in a second direction y. The prong members 16, 17 include pointed ends 30, 30' along with the barbs 32, 32' located along a length of the prong members 16, 17.

While a specific embodiment of the invention has been described in detail, it will be appreciated by those skilled in the art that various modifications and alternatives to those details could be developed in light of the overall teachings of the disclosure. The presently preferred embodiment described herein is meant to be illustrative only and not limiting as to the scope of the invention which is to be given the full breadth of the appended claims and any and all equivalents thereof.

The invention claimed is:

1. A roof deck comprising:

a structural panel comprising a bottom member, an upper member, side members extending from said upper member, and a receiving cavity located between said bottom member and said upper member, said receiving cavity being defined by at least said side members and said bottom member;

a sound-absorbing media configured for placement within said receiving cavity; and a plurality of clips, wherein each clip comprises a body having a first side and a second side, a step portion positioned between and offset with respect to the first side and the second side, and a first prong member projecting outward from the first side of the body, and wherein at least an end portion of the first prong penetrates through at least a portion of the sound-absorbing media and the sound-absorbing media with the at least one clip is placed into the receiving cavity of the structural panel such that the clip is located between the sound-absorbing media and the bottom member the first prong member extends in a first direction from the body and the step portion extends in a second direction from the body.

2. The roof deck according to claim 1, wherein the bottom member of the structural panel is perforated.

3. The roof deck according to claim 1, wherein the clip further includes a second prong member projecting outward from the second side of the body.

4. The roof deck according to claim 1, wherein the end portion of the first prong member has a pointed tip and the first prong member includes at least one barb along a length thereof.

5. The roof deck according to claim 1, wherein the step portion has about a 0.25 inch-0.50 inch step radius.

6. The roof deck according to claim 1, wherein the step portion is configured for separating the sound-absorbing media from the bottom member.

7. The roof deck according to claim 6, wherein the step portion is configured to rest on the bottom member.

8. The roof deck according to claim 7, wherein the bottom member is perforated and the sound-absorbing media comprises a fibrous material.

* * * * *